United States Patent [19]

Chapman

[11] 4,055,330

[45] Oct. 25, 1977

[54] LIFTING DEVICE FOR RAISING AND FREEING STUCK VEHICLES

[76] Inventor: Donald A. Chapman, 14997 S. Furrow Road, Larkspur, Colo. 80118

[21] Appl. No.: 777,823

[22] Filed: Mar. 15, 1977

[51] Int. Cl.[2] ..... B66F 3/00

[52] U.S. Cl. ..... 254/131

[58] Field of Search ..... 254/120, 131, 132

[56] References Cited

U.S. PATENT DOCUMENTS 178,527 6/1876 Howell ..... 254/132

FOREIGN PATENT DOCUMENTS 616,749 4/1933 Germany ..... 254/131

*Primary Examiner*—Robert C. Watson

*Attorney, Agent, or Firm*—W. Britton Moore

[57] ABSTRACT

A portable lifting device for raising and freeing stuck and mired vehicles including a pair of wide spaced generally flat channel iron supporting plates spanned and having a wide flat channeled base plate removably connected thereto with the lower end of a two part telescopically adjustable lever fulcrummed therein. The lever is angled toward the stuck vehicle and a chain from a towing vehicle is positioned over the forked upper end of the lever and is attached to the vehicle so that when a pull is exerted on the chain the lever swings upwardly and forwardly and lifts the attached end of the vehicle until the lever falls free of the chain permitting the vehicle to be towed thereover without interruption.

Figure 1:
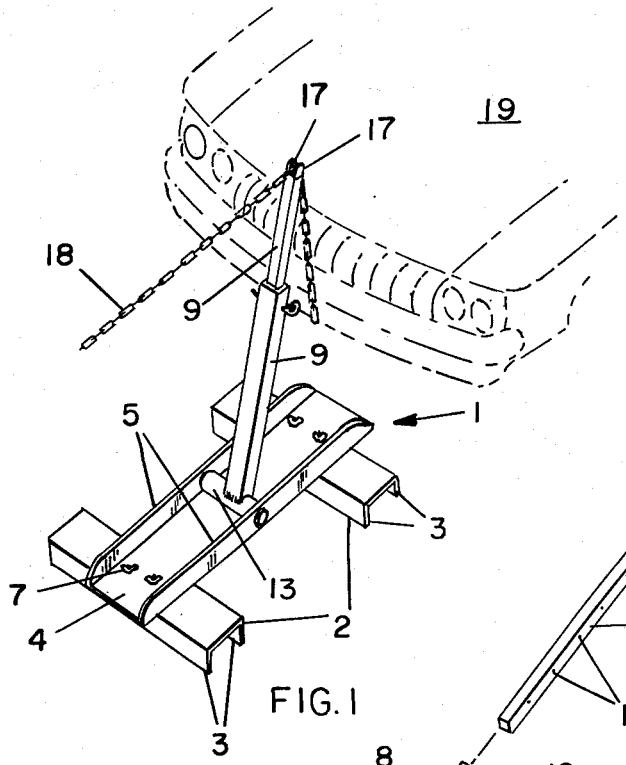
Figure 2:
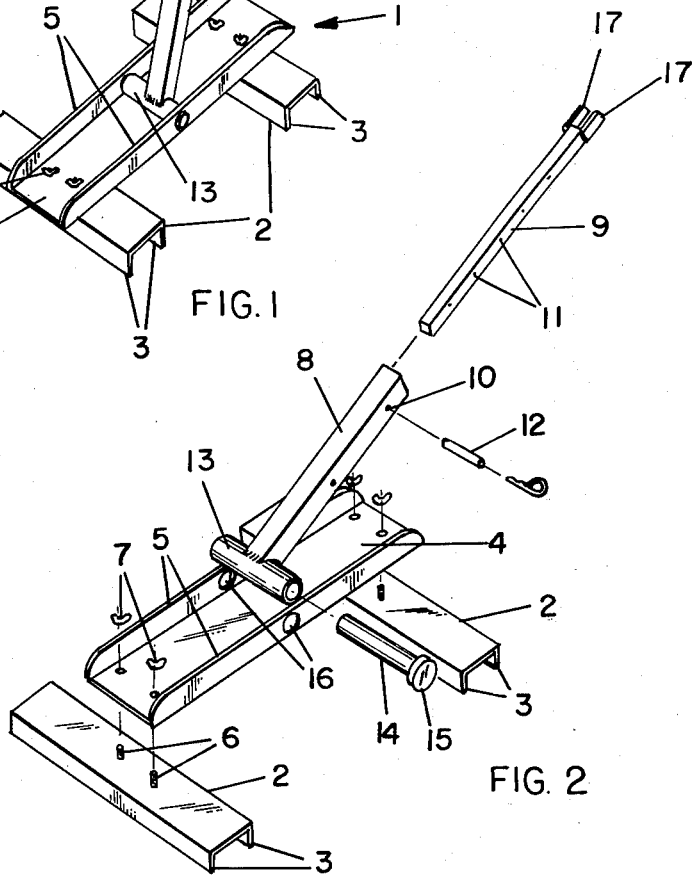
Figure 3:
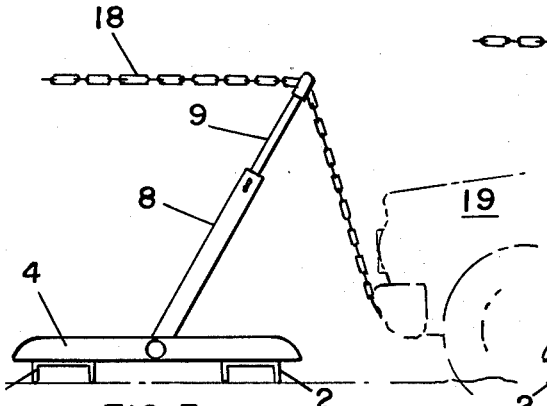
Figure 4:
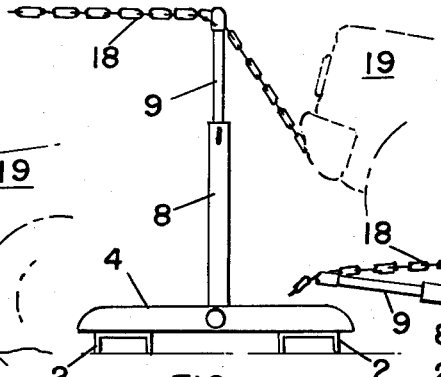
Figure 5:
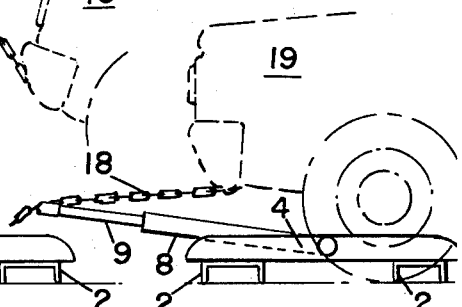

6 Claims, 5 Drawing Figures